United States Patent [19]

Keady et al.

[11] Patent Number: 4,709,817

[45] Date of Patent: Dec. 1, 1987

[54] CONTAINER AND PROTECTIVE INSERT FOR SHOCK SENSITIVE DEVICES

[75] Inventors: Peter Keady, Menlo Park; Thomas P. Magennis, Fremont, both of Calif.

[73] Assignee: Viking Container Company, San Jose, Calif.

[21] Appl. No.: 827,631

[22] Filed: Feb. 10, 1986

[51] Int. Cl.[4] ..... B65D 85/30; B65D 5/50

[52] U.S. Cl. ..... 206/523; 206/521; 206/585; 206/592

[58] Field of Search ..... 206/521, 523, 524, 585, 206/592, 593, 591

[56] References Cited

U.S. PATENT DOCUMENTS

| | | | |
|---|---|---|---|
| 1,093,407 | 4/1914 | Hammond | 206/585 |
| 1,793,367 | 2/1931 | McVay et al. | 206/521 |
| 2,894,671 | 7/1959 | Nicholls | 206/459 |
| 2,954,140 | 9/1960 | Sutherland et al. | 206/585 |
| 2,979,246 | 4/1961 | Liebeskind | 206/523 |
| 3,191,791 | 6/1965 | Jackson | 206/585 |
| 3,266,705 | 8/1966 | Wood | 206/521 |
| 3,275,131 | 9/1966 | Erickson | 206/523 |
| 3,283,988 | 11/1966 | Hardigg | 206/521 |
| 3,445,051 | 5/1969 | Goldman | 206/521 |
| 3,587,838 | 6/1971 | Miyata | 206/592 |
| 4,240,240 | 12/1980 | Cohen | 206/523 |

FOREIGN PATENT DOCUMENTS

| | | | |
|---|---|---|---|
| 1053189 | 4/1979 | Canada | 206/521 |

*Primary Examiner*—William Price
*Assistant Examiner*—Brenda J. Ehrhardt
*Attorney, Agent, or Firm*—Owen, Wickersham & Erickson

[57] ABSTRACT

A shock protective device for use with a carton for shipping shock sensitive products. The device comprises a foldable padded insert which fits inside the carton. The insert folds over and surrounds the product to be shipped with a first group of interior blocks of shock absorbing material attached to one face thereof. A second group of exterior blocks of shock absorbing material are attached to the opposite face of the insert which hold the insert in place within the carton. The exterior blocks are vertically aligned with the interior blocks when the insert is folded over a product to be shipped to preclude squashing of the device within the carton during shipment. The exterior blocks absorb shock transmitted to the carton and the interior blocks absorb any shock transmitted to the insert within the carton.

6 Claims, 6 Drawing Figures

CONTAINER AND PROTECTIVE INSERT FOR SHOCK SENSITIVE DEVICES

This invention relates to shipping containers and, more particularly, to a protective insert for a carton for shipping shock sensitive devices.

BACKGROUND OF THE INVENTION

Corrugated shipping containers have long been used to ship shock sensitive devices. Normally, such containers have been supplemented with various padding means to protect the device and absorb shock transmitted to the container during shipment. Such shock absorbing means often took the form of foam plastic members. Heretofore, such plastic members often comprised relatively large blocks of foam with a cut-out portion to accommodate with device being shipped. Upon arrival, the foam plastic with it cut-out portion was discarded. Thus, in mass production, this prior method was costly. Other typical containers used for sensitive devices comprised a padded insert placed within a carton. At least part of the padded insert containing the device was often made of corrugated paper material which is less expensive than molded foam plastic padding. However, in such instances full planks of foam plastic padding were usually laid across the exterior of the insert to isolate and protect the paper insert. Aside from using extraordinary amounts of foam plastics, these planks were bulky and difficult for the shipper to store in mass quantities. Other known shipping containers have utilized a plank of padding which was cut out in the center to form a collar-like ring. This ring would be placed within a protective insert which enclosed the device to be shipped within a shipping container. However, in order to mass produce such collars effectively expensive, custom made machine dies were required to form a particular shaped collar. The aforesaid problems have been solved by the present invention which provides a foldable padded insert which efficiently combines the features of paper and foam plastic and fits inside a carton for protecting shock sensitive devices during shipment.

Another object of the present invention is to provide a padded shipping container which economically and efficiently utilizes simple blocks of shock resistant material fixed to a foldable sheet.

Yet another object of the present invention is to provide a protective insert which fits inside a carton and utilizes relatively simple padding forms that do not require machine die production.

Still another object of the present invention is to provide a padded shipping container which utilizes a protective, shock resistant padding form that can be nested together and easily stored.

SUMMARY OF THE INVENTION

In accordance with the principles of the present invention, a shock protective device for shipping shock sensitive products is provided in the form of a foldable padded insert which fits inside a carton. Such a carton can be a regular slotted carton, a full overlap carton, a partial overlap carton or a die cut carton. The padded insert folds over along a series of scores and encloses the product to be shipped, such as a delicate electromechanical device. The insert has tab-like extensions which fit into pre-cut slots thereby locking the insert into a folded over position. Other embodiments need not include the locking tabs and corresponding slots. A first group of interior blocks of shock absorbing material are attached to one face of the insert at precise locations to effectively surround and hold the shock-sensitive product in place. A second group of exterior blocks of shock absorbing material are attached to the opposite face of the insert to hold the insert device in place within the carton.

When the insert is folded over a product to be shipped, the first group of blocks of shock absorbing material are vertically aligned with the second group of blocks of shock absorbing material to preclude squashing or flattening of the insert within the carton during shipment. The exterior blocks serve to isolate the insert from the carton and absorb shock transmitted to the carton. The interior blocks serve to isolate the enclosed product from the insert device and absorb any shock transmitted to the insert within the carton.

Other objects, advantages and features of the invention will become apparent from the following detailed description of embodiments thereof presented in conjunction with the accompanying drawing.

DETAILED DESCRIPTION OF THE PREFERRED EMBODIMENT

Figure 1:
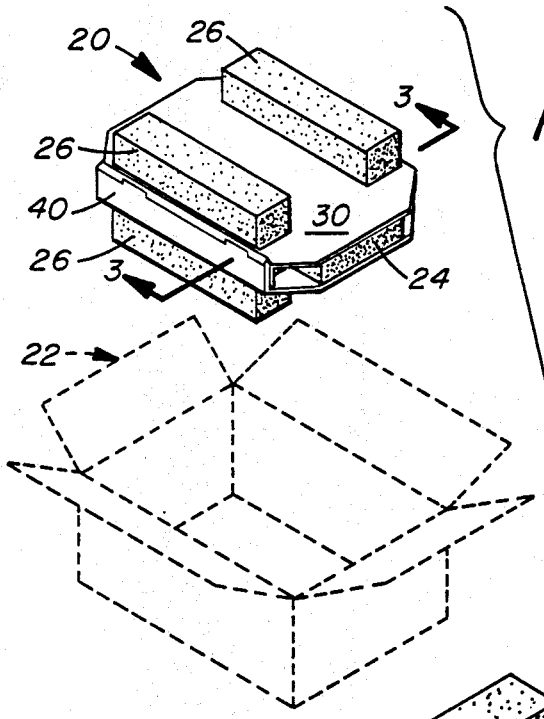
FIG. 1 is a view in perspective of the shock protective device according to the present invention showing a padded insert folded over a product to be shipped; the device being shown above a carton (shown below in phantom) within which it fits.

With reference to the drawing, FIG. 1 shows a shipping device 20 embodying the principles of the present invention for shipping shock sensitive products. The shipping device 20 is placed within a carton 22, such as a regular slotted carton shown in phantom below the device. The shipping device 20 is essentially a blank comprising a foldable insert with padding blocks 24 on the interior or upper surface thereof and similar blocks 26 on the exterior a lower surface thereof thereof for use with the carbon 22. The padding blocks 24 and 26 are preferably formed from a suitable foam plastic material such as polyurethane. They are relatively light weight but capable of withstanding considerable compression forces.

Figure 2:
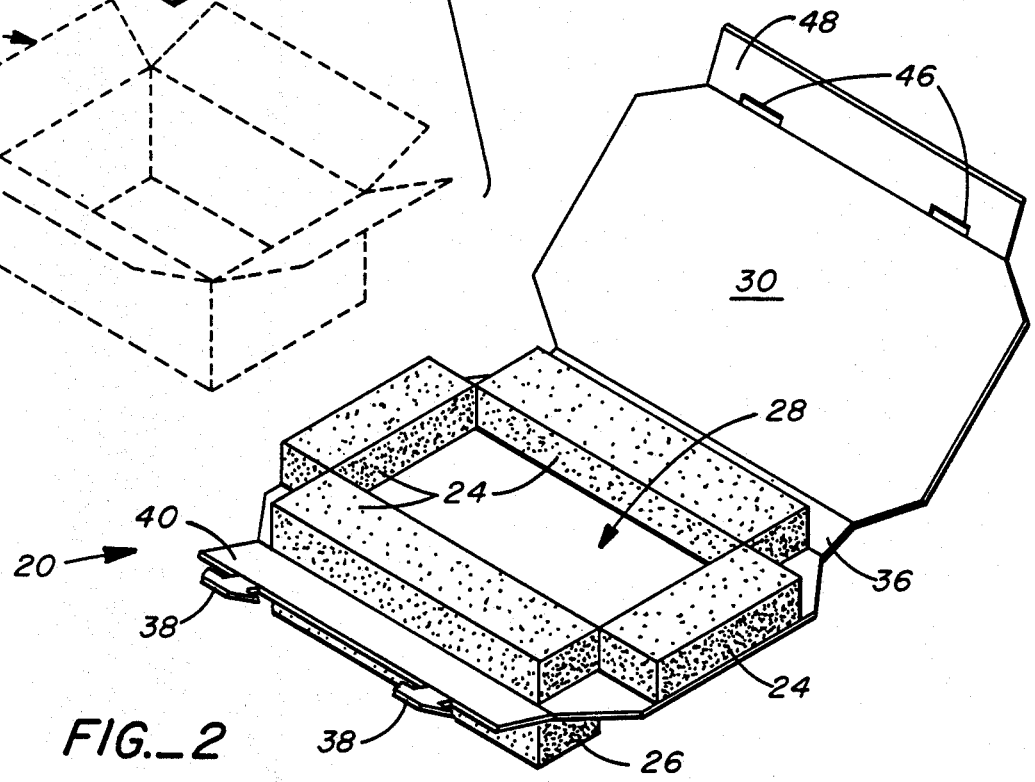
FIG. 2 is a view in perspective of the padded insert of FIG. 1 showing the insert unfolded with the interior padding blocks exposed.
Figure 3:
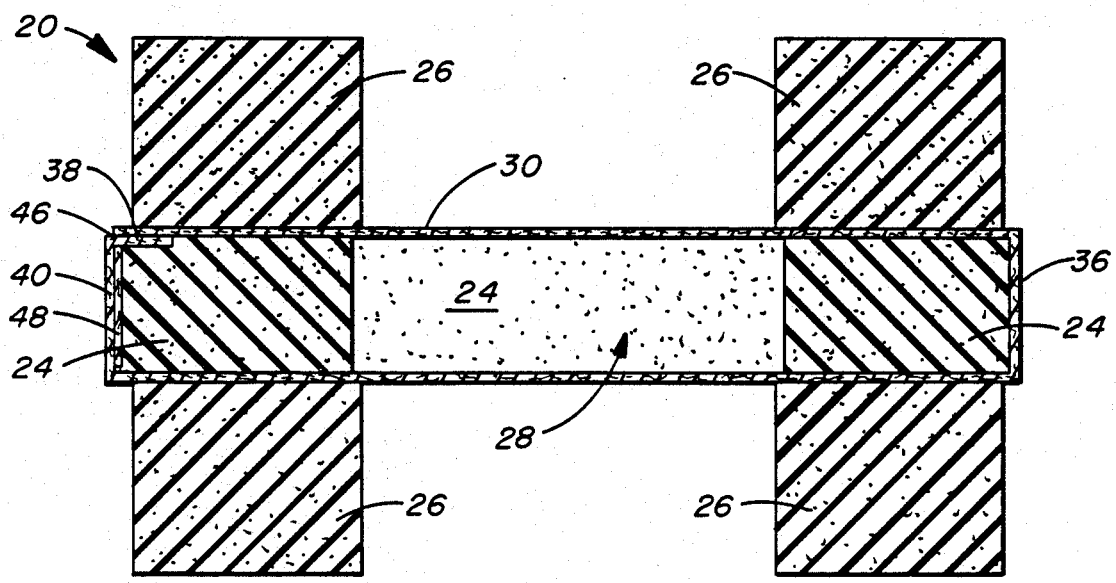
FIG. 3 is a side view of the padded insert folded over a device to be shipped taken along the line 3—3 of FIG. 1.

FIG. 2 shows the shipping device 20 unfolded with the interior oppositely placed foam blocks 24 exposed. These interior blocks of padding form a space 28 to accommodate the shock sensitive product to be shipped. The shipping device or insert 20 is folded over and effectively surrounds the shock sensitive product to be shipped as shown in FIG. 3. The exterior padding blocks 26 isolate the shipping device 20 from the carton and absorb shock transmitted to the carton while the interior blocks 24 effectively surround and isolate the shock sensitive product to be shipped and absorb any shock transmitted to the shipping device 20 within the carton.

Figure 4:
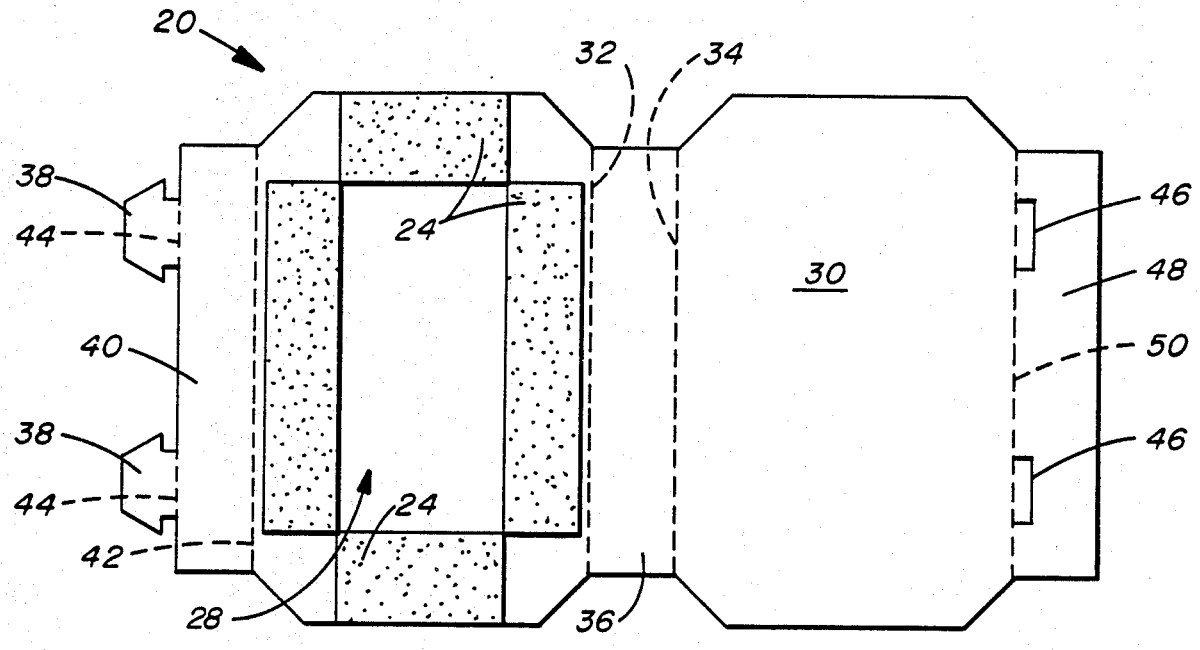
FIG. 4 is a top view of the padded insert of FIG. 1 showing the insert unfolded and laying flat with the interior padding blocks exposed.
Figure 6:
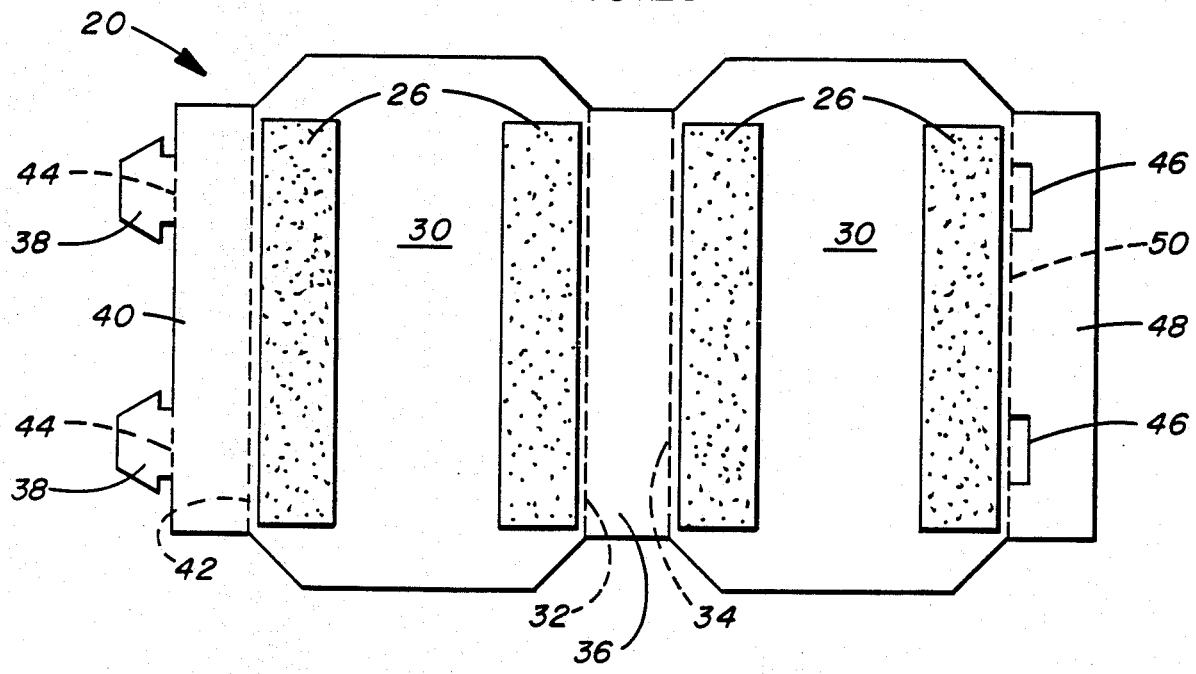
FIG. 6 is a bottom view of the padded insert of FIG. 1 showing the insert unfolded and laying flat.

FIG. 4 is a top view from above showing the shipping device 20 unfolded and laying flat and exposing the interior blocks of padding 24 which form an opening 28 that accommodates the shock sensitive product being shipped. The shipping device or blank 20 is made from a pre-cut die pressed base sheet 30 of carton material such as standard corrugated board. The sheet 30 folds over along pre-cut scores 32 and 34 which bound a rear hinge-like panel 36. In addition, the sheet 30 has tab-like extensions 38 that extend from a tab-flap panel portion 40 on one distal end of the sheet. The tab-flap portion 40 folds along a score line 42. The tab-like extensions 38 fold along score lines 44 and fit into pre-cut slots 46 on the opposite distal end of the sheet 30. A slot-flap panel portion 48 folds along a score line 50. The blocks 24 all lie in a base area between the score lines 32 and 42, some of the blocks 24 preferably being adjacent to and parallel to the score lines 32 and 42, with other blocks 24 preferably being perpendicular to them and adjacent to the blank's side edges. FIG. 6 shows the aforesaid structural features from the bottom looking at the exterior of the unfolded shipping device 20.

Figure 5:
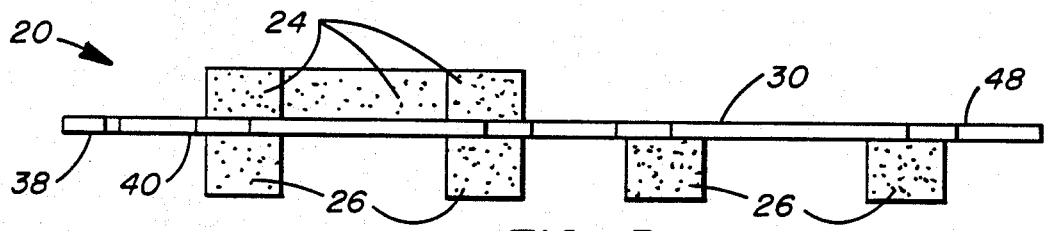
FIG. 5 is a side view of the padded insert showing the insert unfolded and laying flat.

FIG. 5 is a side view of the shipping device 20 unfolded and lying open. A die pressed sheet 30 of carton material is pre-cut to size with score lines formed at locations which enable the shipping device to be folded for use. Next the interior blocks of padding 24 and the exterior blocks of padding 26 are attached to the sheet 30.

One group of the blanks 26 is secured to the lower surface of the blank 20 directly in line with some of the blocks 24. Other blocks 26, also secured to the lower surfaces of the blank 20, lie between the score lines 34 and 50, so that when the area is folded over to provide a cover area, these blocks 26 are than aligned with some of the blocks 24.

Referring back to FIG. 3, the tab-flap portion 40 folds over and encloses the slot flap portion 48 when the shipping device 20 is in a locked folded over shipping configuration. When the device 20 is in a locked folded over position, with extensions 38 inserted within slot 46, the exterior blocks of padding 26 are vertically aligned with the interior blocks of padding 24. This vertical alignment of interior and exterior padding blocks precludes any squashing of the device within the carton during shipment.

In summary, the shipping device 20 encloses a shock sensitive product such as an electrical/mechanical device to be shipped and is placed with a snug fit within a carton. The foldable die pressed insert sheet 30 completely surrounds the product, while the exterior padding blocks 26 protect the insert from shock transmitted to the carton, and the interior padding blocks 24 surrounding the shock sensitive product protect it from shock transmitted to the insert within the carton during shipment. The tab-like extensions 38 which fit into the pre-cut slots 46 serve to lock the insert into its closed folded over position. The resulting vertical alignment of the exterior and interior padding blocks 24 and 26 preclude squashing of the protective shipping device 20 within a carton, thereby affording a high degree of reliable protection during shipment. The simple oblong shaped blocks of padding attached to the sheet 30 may be efficiently and inexpensively produced and can be stored easily. Thus, shock sensitive products can be protected during shipment at a very moderate cost through the use of the present invention.

To those skilled in the art to which this invention relates, many changes in construction and widely differing embodiments and application of the invention will suggest themselves without departing from the spirit and scope of the invention. The disclosures and descriptions herein are purely illustrative and are not intended to be in any sense limiting.

What is claimed is:

1. A blank for forming a shock-resistant unit for protecting from shock an article and for insertion, with said article inside said unit, into a shipping carton, including in combination:

a base sheet having end and side edges and a series of first, parallel score lines, parallel to said end edges, enabling folding and defining a base area between two of said score lines, a narrow connecting area between a pair of score lines, and a cover area between a pair of score lines, said narrow area lying between and immediately ajoining said base and cover areas, said base sheet having an upper surface and a lower surface, a first group of shock-resistant blocks secured to said upper surface in said base area and defining an article-receiving space, the thickness of said blocks being approximately equal to the width of said connecting area, to enable folding of said sheet so that said cover area can overlie and engage the upper surfaces of said blocks, a second group of shock-resistant blocks secured to said lower surface of said sheet in said base area and generally aligned with at least some portions of said first group of blocks, and a third group of shock-resistant blocks secured to said lower surface in said cover area and comprising a second pair of blocks and aligned so that when said cover area is folded over said first group of blocks, said third group of blocks are generally aligned with at least some portions of said second groups of blocks.

2. The blank of claim 1 wherein said blocks fully enclose said article's receiving space.

3. A blank for forming a shock-resistant unit for enclosing and protecting from shock an article and for insertion, with said article inside said unit, into a shipping carton, including in combination:

a base sheet having end and side edges and first, second, third and fourth parallel score lines, parallel to said end edges, enabling folding and defining a first, flap area between said first score line and an adjacent first end edge, a second, base area between said first and second score lines, a third, linking area between said second and third score lines, a fourth, cover area between said third and fourth score lines, and a fifth, flap area between said fourth score line, and an adjacent second end edge, said base sheet having an upper surface and a lower surface, a first group of shock-resistant blocks secured to said upper surface in said second area and defining an article-receiving space between them, a first said block lying closely adjacent to and parallel to said first score line, a second said block, parallel to said first block and closely adjacent to and parallel to said second score line, a third said block perpendicular to said first and second blocks and lying closely adjacent to and parallel to a first said side edge, and a fourth said block parallel to said third block lying adjacent to and parallel to a second said side edge, the thickness of said blocks being approximately equal to the width of said third area, to enable folding so that said fourth area overlies and engages the upper surfaces of said first group of blocks, a second group of shock-resistant blocks secured to said lower surface of said sheet in said second area and comprising a pair of blocks directly in line with said first and second blocks, and a third group of shock-resistant blocks secured to said lower surface in said fourth area and comprising a pair of blocks aligned so that when said fourth area is folded over said first group of blocks, said second pair of blocks are directly in line with said first and second blocks.

4. The blank of claim 3 having a pair of locking tabs projecting out from said first edge, and a pair of notches along said fourth score line for receiving said tabs therethrough.

5. A blank for forming a shock-resistant unit for enclosing and protecting from shock an article and for insertion, with said article inside said unit, into a shipping carton including in combination:

a base sheet having end and side edges and first, second, third and fourth parallel score lines, parallel to said end edges, enabling folding and defining a first, flap area between said first score line and an adjacent first end edge, a second, base area between said first and second score lines, a third, linking area between said second and third score lines, a fourth, cover area between said third and fourth score lines, and a fifth, flap area between said fourth score lines, and an adjacent second end edge, said base sheet having an upper surface and a lower surface, a first group of four rectangular, shock-resistant, polyurethane blocks secured to said upper surface in said second area, said blocks having meeting inner edges defining a rectangular article-receiving space between them, a first said block lying closely adjacent to and parallel to said first score line, a second said block, parallel to said first block lying closely adjacent to and parallel to said second score line, a third said block perpendicular to said first and second blocks and lying closely adjacent to and parallel to a first said side edge, and a fourth said block parallel to said third block lying adjacent to and parallel to a second said side edge, the thickness of said blocks being approximately equal to the distance between said third and fourth score lines, to enable folding so that said fourth area overlies and engages the upper surfaces of said first group of blocks, the thickness of said blocks being also approximately equal to the widths of said flap areas, a second group of rectangular, shock-resistant, polyurethane blocks secured to said lower surface of said sheet in said second area and comprising fifth and sixth blocks, respectively directly in line with said first and second blocks, a third group of rectangular shock-resistant, polyurethane blocks secured to said lower surface in said fourth area and comprising a seventh and eighth blocks aligned so that when said fourth area is folded over said first group of blocks, said seventh and eighth blocks are directly in line with said first and second blocks, a pair of locking tabs projecting out from said first end edge and connected thereto by short score lines, and a pair of notches along said fourth fold line for receiving said tabs therethrough.

6. A blank for forming a shock-resistant unit for protecting from shock an article and for insertion, with said article inside said unit, into a shipping carton, including in combination:

a base sheet having end and side edges and a series of first, parallel score lines, parallel to said end edges, enabling folding and defining a base area between two of said score lines, a narrow connecting area between a pair of score lines, and a cover area between a pair of score lines, said narrow area lying between and immediately ajoining said base and cover areas, said base sheet having an upper surface and a lower surface, a first group of shock-resistant blocks secured to said upper surface in said second area and defining an article-receiving space, the thickness of said blocks being approximately equal to the width of said third area, to enable folding of said sheet so that said cover area can overlie and engage the upper surfaces of said blocks, a second group of shock-resistant blocks secured to said lower surface of said sheet in said base area and aligned with said article-receiving space, and a third group of shock-resistant blocks secured to said lower surface in said cover area and comprising a second pair of blocks and aligned so that when said cover area is folded over said first group of blocks, said third group of blocks are aligned with said article-receiving space.

* * * * *